US005262079A

United States Patent [19]

Kacher et al.

[11] Patent Number: 5,262,079

[45] Date of Patent: Nov. 16, 1993

[54] FRAMED NEUTRAL PH CLEANSING BAR

[75] Inventors: Mark L. Kacher, Mason; James E. Taneri, West Chester, both of Ohio; Daniel J. Quiram, Charlottesville, Va.; Diane G. Schmidt; Marcus W. Evans, both of Cincinnati, Ohio

[73] Assignee: The Procter & Gamble Company, Cincinnati, Ohio

[21] Appl. No.: 854,932

[22] Filed: Mar. 20, 1992

[51] Int. Cl.[5] ..... C11D 9/48; C11D 10/04; C11D 13/12; C11D 13/16

[52] U.S. Cl. ..... 252/112; 252/108; 252/109; 252/110; 252/111; 252/113; 252/117; 252/118; 252/121; 252/122; 252/131; 252/132; 252/134; 252/174; 252/368; 252/370; 252/554; 252/557; 252/DIG. 5; 252/DIG. 16

[58] Field of Search ..... 252/108, 109, 110, 111, 252/117, 118, 121, 122, 131, 132, 134, 140, 174, 367, 368, 369, DIG. 16, 354, 357, DIG. 5, 370

[56] References Cited

U.S. PATENT DOCUMENTS

| | | | |
|---|---|---|---|
| 2,826,551 | 3/1958 | Geen | 252/89 |
| 2,988,511 | 6/1961 | Mills et al. | 252/121 |
| 2,988,551 | 6/1961 | Morren | 260/268 |
| 3,351,558 | 11/1967 | Zimmerer | 252/137 |
| 3,557,006 | 1/1971 | Ferrara et al. | 252/117 |
| 3,835,058 | 9/1974 | White | 252/121 |
| 3,835,059 | 9/1974 | Fukuta et al. | 252/305 |
| 4,234,646 | 11/1980 | Morshaser | 252/594 |
| 4,606,839 | 8/1986 | Hardin | 252/132 |
| 4,673,525 | 6/1987 | Small et al. | 252/132 |
| 4,704,223 | 11/1987 | Gupta et al. | 252/132 |
| 4,954,282 | 9/1990 | Rys et al. | 252/117 |

FOREIGN PATENT DOCUMENTS

| | | |
|---|---|---|
| 57-61800 | 12/1982 | Japan . |
| 60-23156 | 6/1985 | Japan . |
| 513696 | 10/1938 | United Kingdom . |

*Primary Examiner*—Dennis Albrecht
*Attorney, Agent, or Firm*—Leonard Williamson

[57] ABSTRACT

The invention provides a firm, ultra mild, neutral pH cleansing bar comprising: from about 5% to about 50% of monocarboxylic acid; wherein from about 20% to about 65% by weight of said monocarboxylic acid is neutralized; from about 20% to about 65% of an anionic and/or nonionic bar firmness aid, and from about 15% to about 55% water by weight of said bar;

wherein said free monocarboxylic acid is from about 35% to about 80% by weight of said mixture of free and neutralized monocarboxylic acid;

wherein said neutral pH is from about 6.3 to about 8.0;

wherein the said neutralized monocarboxylic acid has a cation selected from the group consisting of sodium, magnesium, calcium, aluminum, and mixtures thereof; and wherein said bar comprises a rigid crystalline phase skeleton structure comprising an interlocking, open three-dimensional mesh of elongated crystals consisting essentially of said monocarboxylic acid.

25 Claims, No Drawings

FRAMED NEUTRAL PH CLEANSING BAR

TECHNICAL FIELD

This invention relates to carboxylic acid based cleansing bars.

BACKGROUND

Neutral pH bars, per se, are known. Prior art neutral pH bars do not include substantial levels of hygroscopic materials, soft solids, and liquids, including water, without becoming soft or sticky with poor smears. Firm, low smear, neutral pH cleansing bars as defined herein, are believed to be novel and unexpectedly firm with good smear.

U.S. Pat. No. 3,557,006, Ferrara et al., issued Jan. 19, 1971, discloses a composite soap bar having an acid pH in use. Other background references are: U.K. Pat. Specification 513,696, Mangest, accepted Oct. 19, 1939; Jap. Pat. Application. No. 54-151410, filed Nov. 21, 1979, and published Jun. 6, 1985; and U.S. Pat. No. 4,606,839 Harding, issued Aug. 19, 1986.

Some commercial neutral pH bars are: DOVE®, CARESS®, and OLAY®.

U.S. Pat. No. 2,988,511, Mills, issued Jun. 13, 1961, incorporated herein by reference, discloses a low smearing bar.

Bar smear, also referred to as bar sloth, is the soft solid or mush that forms at the surface of a bar when submerged in water and is regarded by consumers as messy, unattractive, and uneconomical.

However, an examination of a used personal cleansing bars in today's average bathroom will show that there is still a need to improve cleansing bar smear.

Bar smear is especially poor in neutral pH bar formulations which contain higher levels (50%±10%) of synthetic surfactant.

The formation of rigid, soap curd fibers of sodium laurate is reported by L. Marton et al. in a 1940 Journal of American Chemical Society (Vol. 63, pp. 1990–1993).

Japanese Pat. J5 7030–798, Jul. 30, 1980, discloses transparent solid framed or molded soap bar.

It is an object of the present invention to produce a firm, mild, neutral pH, low smear cleansing bar that contains relatively high level of moisture in the presence of a synthetic surfactant and soft solids, such as water-soluble polyols and hydrocarbon greases.

SUMMARY OF THE INVENTION

The invention provides a firm, ultra mild, neutral pH cleansing bar comprising: from about 5% to about 50% of monocarboxylic acid; wherein from about 20% to about 65% by weight of said monocarboxylic acid is neutralized; from about 20% to about 65% of an anionic and/or nonionic bar firmness aid, and from about 15% to about 55% water by weight of said bar;

wherein said free monocarboxylic acid is from about 35% to about 80% by weight of said mixture of free and neutralized monocarboxylic acid;

wherein said neutral pH is from about 6.3 to about 8.0;

wherein the said neutralized monocarboxylic acid has a cation selected from the group consisting of sodium, magnesium, calcium, aluminum, and mixtures thereof; and wherein said bar comprises a rigid crystalline phase skeleton structure comprising an interlocking, open three-dimensional mesh of elongated crystals consisting essentially of said monocarboxylic acid.

DETAILED DESCRIPTION OF THE INVENTION

The invention provides a firm, ultra mild, neutral pH cleansing bar comprising: from about 5% to about 50% of monocarboxylic acid; wherein from about 20% to about 65% by weight of said monocarboxylic acid is neutralized; from about 15% to about 65% of an anionic and/or nonionic bar firmness aid, said bar firmness aid preferably comprising at least 5% synthetic surfactant by weight of said bar; and from about 15% to about 55% water by weight of said bar;

wherein the said neutralized monocarboxylic acid has a cation selected from the group consisting of sodium, magnesium, calcium, aluminum, and mixtures thereof;

wherein said neutralized carboxylic acid and said synthetic surfactant sum is preferably from about 10% to about 65%, more preferably from about 25% to about 50%, by weight of said bar.

wherein said bar comprises a rigid crystalline phase skeleton structure comprising an interlocking, open three-dimensional mesh of elongated crystals consisting essentially of said monocarboxylic acid.

The terms "carboxylic acid" and "monocarboxylic acid" are used interchangeably, unless otherwise specified, and are defined herein to include the "free" carboxylic acid and neutralized carboxylic acid present in the bar, unless otherwise specified.

The term "neutral pH" as used herein means that the bar (1% solution) has a pH from about 6.3 to about 8.0, particularly 6.5 to 7.5.

"Weakly acidic" as used herein means that the bar (1%) has a pH of from about 4.8 to about 6 which is distinguished from a neutral pH bar. A weakly acidic, skin pH bar is the subject matter of commonly assigned, copending U.S. pat. appln. Ser. No. 854,927, Kacher et al., filed of even date, Mar. 20, 1992, incorporated herein by reference in its entirety. In that application a maximum of 15% of the carboxylic acid is neutralized.

The terms "neutralized carboxylic acid," "soap", "fatty acid (FA) salts" and "monocarboxylic acid salts" as used herein are used interchangeably.

The firm cleansing bar has a penetration value of from zero up to 12 mm as measured at 25° C., preferably at 50° C., using a 247 gram Standard Weighted Penetrometer Probe having a conical needle attached to a 9 inch (22.9 cm) shaft, weighing 47 grams with 200 grams on top of said shaft for a total of said 247 grams, said conical needle having a 19/32 inch (1.51 cm) top and a 1/32 inch (0.08 cm) point.

In another respect, the present invention provides a firm, neutral pH cleansing bar comprising: at least two phases and a sum total of from about 5% to about 50% of a mixture of free and neutralized carboxylic acid; from about 15% to about 65% of an anionic and/or nonionic bar firmness aid preferably of which at least about 5% by weight of said bar is a synthetic surfactant; and from about 15% to about 55% water by weight of said bar.

One particularly surprising aspect of the present invention is that the anionic and/or nonionic bar firmness aid are required to form an acceptably firm bar. These bar firmness aids include solvents such as propylene glycol and synthetic surfactants, such as sodium acyl isethionate, that typically result in bar softening in conventional bars, especially in the presence of relatively high levels of water.

In another respect, the bar of the present invention comprises a rigid crystalline phase skeleton structure comprising an interlocking, open, three-dimensional mesh of elongated crystals consisting essentially of a mixture of said free and neutralized carboxylic acid.

Another phase in the bar of the present invention is an aqueous phase mix. The aqueous mix (when measured alone without carboxylic acid) has a penetration value of greater than 12 mm to complete penetration at 25° C.

More specifically, the skeleton structure is a relatively rigid, interlocking, open, three-dimensional mesh of monocarboxylic acid elongated crystals.

The "elongated crystals" are platelets and/or fibers.

The terms "skeleton structure," "skeletal structure," "core," and "skeleton frame" are often used interchangeably herein.

The term "shaped solid" as used herein includes forms such as bars, cakes, and the like. The term "bar" as used herein includes the same unless otherwise specified.

The term "mesh" as used herein means an interlocking crystalline skeleton network with voids or openings when viewed under magnification of from about 1,000X to about 5,000X by scanning electron microscopy.

The three-dimensional mesh can be seen using a Scanning Electron Microscope. The Scanning Electron Microscopy (SEM) sample preparation involves fracturing a bar (shaped solid) with simple pressure to obtain a fresh surface for examination. The fractured sample is reduced in size (razor blade) to approximately a 10 mm×15 mm rectangle with a thickness of about 5 mm. The sample is mounted on an aluminum SE[4 stub using silver paint adhesive. The mounted sample is coated with approximately 300 angstroms of gold/palladium in a Pelco sputter coater. Prior to coating, the sample is subjected to vacuum for a period of time which is sufficient to allow sufficient loss of bar moisture assuring acceptable coating quality. After coating, the sample is transferred to the SEM chamber and examined under standard SEM operating conditions with an Hitachi Model S570 Scanning Electron Microscope in order to see the skeletal (core) frame.

The elongated crystals are composed of selected mixtures of free and neutralized carboxylic acid and are therefore are different from the soap or primarily neutralized carboxylic acid, elongated crystals of commonly assigned U.S. pat. appln. Ser. No. 07/617,827, Kacher et al., filed Nov. 26, 1990, now abandoned in favor of commonly assigned U.S. pat. appln. Ser. No. 07/782,956, filed Nov. 1, 1991, incorporated herein be reference. In these cases, the pH's of the exemplified bars (1% solution) are about 9 to 10 vs. a neutral pH of 6.3 to 8. Since healthy human skin is slightly acidic (pH from about 4.8 to about 6.0), it is desirable that a skin cleansing bar have a similar pH. Neutral pH formulations can contain higher levels of free carboxylic acid while containing less harsh soap. Bar firmness aids, as defined herein, are not required in these cases either, but are required in the present invention.

In another respect, the present invention provides an improved firm, neutral pH cleansing bar which is comprised of said skeleton structure. Some shaped solids are in the form of cleansing bars which contain surprisingly high levels of said aqueous phase comprising water, other liquids and soft materials. Notwithstanding the presence of relatively large levels of an aqueous phase, the preferred bars of the present invention maintain their rigidity and excellent smear properties, even when allowed to soak overnight in water. While not being bound to any theory, the shaped solid comprising these phases is similar to a relatively rigid wet sponge.

The crystalline phase comprises elongated crystals in the form of either interlocking platelets and/or fibers, usually platelets. Preferably said crystals are composed of carboxylic acids. The interlocking mesh of said fibers and/or platelets imparts strength to the three-dimensional structure, even in the presence of relatively high levels of water or other soft materials; even when allowed to soak overnight in water.

The bar firmness, i.e., strength of the skeleton structure, can be measured by the resistance to penetration of the bar using a Standard Weighted Penetrometer Probe. See Bar Hardness Test below for more details. The bar is of sufficient firmness or rigidity that a 20 mm thick or greater cleansing bar sample has a penetration at 25° C. of from about zero mm to about 12 mm, preferably from about 1 mm to about 10 on, more preferably from about 3 mm to about 8 mm.

The present bars are distinguished from conventional transparent bars based on crystal size, as well as other characteristics. The crystals or crystal bundles that make-up the interlocking mesh structure of the present invention preferably are of a size that diffracts light and consequently are greater than 400 nm in either diameter or length. On the other hand, conventional transparent bars gain their transparency by having crystal diameters or length less than the wavelength of white light, which is greater than about 400 nm and, consequently, do not diffract light.

While not being bound to any theory, the skeletal structure is theorized to contain substantial "void" areas which are filled by soft and/or liquid aqueous phases. It is a surprising aspect of this invention that the physical properties of the bar, such as bar hardness and little smear, are mostly dependent on the crystalline interlocking mesh structure, even when the other phases make up a majority of the materials present. In conventional bars, many components can impact the overall bar physical properties because the components either modify the phase and structure of the soap or synthetic surfactant components that primarily determine the bar's physical properties. The combination of two or more phases (e.g., soap and aqueous solution) drastically changes the colloidal structure, and consequently, the physical properties of a conventional bar.

Thus, conventional bars are more limited in the type, levels and composition of soft phase materials that can be incorporated into the bar than the present invention. Such phases include most materials that are either flowable liquids or materials that are softer than the minimum hardness of an acceptable bar. These phases include aqueous solutions, liquid crystalline phases composed of water and surfactant, polymers; particularly surfactant-containing crystalline phases, and especially hygroscopic surfactants, which tend to become soft and sticky when mixed with water or other liquid phases including water-soluble organics (e.g., propylene glycol and glycerine), hydrophobic materials (e.g., mineral oil, liquid triglycerides), or soft hydrophobic materials, e.g., petrolatum, low melting paraffin, and low melting triglycerides.

In physical terms, all these phases can be characterized as being flowable liquids or so soft that a Standard Weighted Penetrometer Probe, as defined herein, will penetrate all the way through a 12 mm thick sample, in other words, greater than 12 mm. These phases can be selectively included in the structure of the present invention without loss of the interlocking mesh structure and certain desirable physical properties.

The Carboxylic Acid

In the preferred embodiment, said elongated crystals are composed of carboxylic acid, particularly, those of which at least about 25% have saturated fatty alkyl chains of a single chain length.

A preferred neutral pH bar contains essentially saturated monocarboxylic acid, wherein at least 80% of said monocarboxylic acid has the following general formula:

$$H-(CH_2)_a-\underset{\underset{X}{|}}{CH}-(CH_2)_b-CO_2-H$$

wherein:

a+b=10 to 20;

each a, b=0 to 20;

$$X = H, OR, O-\overset{\overset{O}{\|}}{C}-R_1, R, \text{ or mixtures thereof;}$$

$R=C_1-C_3$ alkyl, H, or mixtures thereof;

$R_1=C_1-C_3$ alkyl.

The carboxylic acids are preferred when: X=H, and a+b=12-20, or X=OH, a=10-16, b=0, or 12-hydroxy stearic acid for said monocarboxylic acid. 12-hydroxy stearic acid forms fibrous elongated crystals.

The neutral pH cleansing bar is preferred when said neutralized carboxylic acid is a sodium salt and the free carboxylic acid and neutralized carboxylic acid sum is from about 15% to about 35%, more preferably from about 20% to about 30%, by weight of the bar.

The neutral pH cleansing bar is preferred when said carboxylic acid is a monocarboxylic acid and wherein free carboxylic acid is from about 50% to about 80%, more preferably from about 60% to about 70%, and said neutralized monocarboxylic acid is from about 20% to about 50%, more preferably from about 30% to about 40%, of said mixture of free monocarboxylic acid and neutralized monocarboxylic acid; and wherein X=H and a+b=10-20 or said monocarboxylic acid is 12-hydroxy stearic acid.

A highly preferred monocarboxylic acid is selected from the group consisting of myristic acid, behenic acid, and 12-hydroxy stearic acid, and mixtures thereof.

Bar Firmness Aid

The neutral pH cleansing bar's firmness aid is preferably selected from the group consisting of:

I. from about 5% to about 50% preferably 10% to 40%, more preferably 20% to 30%, by weight of a synthetic surfactant wherein said synthetic surfactant is selected from the group consisting of: alkyl sulfates, paraffin sulfonates, alkyl glyceryl ether sulfonates, anionic acyl sarcosinates, methyl acyl taurates, linear alkyl benzene sulfonates, N-acyl glutamates, alkyl glucosides, alpha sulfo fatty acid esters, acyl isethionates, glucose amide, alkyl sulfosuccinates, alkyl ether carboxylates, alkyl phosphate esters, ethoxylated alkyl phosphate esters, methyl glucose esters, protein condensates, the alkyl ether sulfates with 1 to 12 ethoxy groups, and mixtures thereof, wherein said surfactants contain $C_8-C_{22}$ alkylene chains; and mixtures thereof; and II. from 0% to about 40%, preferably to about 30%, more preferably 2% to 15%, even more preferably 2% to 10% by weight of a co-solvent wherein said co-solvent is selected from the group consisting of:

(a) non-volatile, water-soluble nonionic organic solvents selected from the group consisting of: a polyol of the structure:

$$R_3-O(CH_2-\underset{\underset{R_4}{|}}{CHO})_kH$$

where $R_3$=H, or $C_1-C_4$ alkyl; $R_4$=H, or $CH_3$; and k=1-200; $C_2-C_{10}$ alkane diols; sorbitol; glycerine; sugars; sugar derivatives; urea; and ethanol amines of the general structure $(HOCH_2CH_2)_xNH_y$ where x=1-3; y=0-2; and x+y=3;

(b) alcohols of from 1 to 5 carbon atoms; and mixtures thereof; and

III. mixtures of (a) and (b).

It is surprising that the above bar firmness aids act to fi m up the bar of the present invention.

The synthetic surfactant preferably contains $C_{10}-C_{18}$ alkylene chains and is a sodium salt. The cleansing bar is more preferred when said synthetic surfactant is a sodium salt selected from the group consisting of: alkyl sulfates, alkyl glyceryl ether sulfonates, linear alkyl benzene sulfonates, alpha sulfo fatty acid esters, acyl isethionates, glucose amides, ethoxylated alkyl ether sulfates with 1 to 6 ethoxy groups, and mixtures thereof, wherein said surfactants contain $C_{10}-C_{18}$ alkylene chains; and mixtures thereof.

A preferred synthetic surfactant is a sodium acyl isethionate selected from the group consisting of sodium cocoyl isethionate and sodium lauroyl isethionate, and mixtures thereof.

A preferred co-solvent is selected from the group consisting of: said polyol wherein $R_3$=H, and k=1-5; glycerine; sugars; sugar derivatives; urea; said ethanol amines, and mixtures thereof. A more preferred co-solvent is selected from the group consisting of: propylene glycol, sucrose, lactose, glycerine, and mixtures thereof. Preferred bar firmness aids have a solubility of at least 4 parts in 10 parts of water at 170°-180° F. (77°-82° C.).

The preferred water level is from about 20% to about 30% by weight of said bar.

Other Cleansing Bar Ingredients

The cleansing bar can contain from about 0.1% to about 60% of other cleansing bar ingredients selected from the group consisting of:

from about 0.5% to about 3% said potassium soap;

from about 0.5% to about 3% triethanolammonium soap;

from about 1% to about 40% of impalpable water-insoluble materials selected from the group consisting of calcium carbonate and talc;

from about 0.1% to about 20% of a polymeric skin feel aid;

from about 0.5% to about 25% of aluminosilicate clay and/or other clays;

wherein said aluminosilicates and clays are selected from the group consisting of zeolites; kaolin, kaolinite, montmorillonite, attapulgite, illite, bentonite, halloysite, and calcined clays;

from about 1% to about 40% of salt and salt hydrates; and mixtures thereof;

wherein said salt and salt hydrate have a cation selected from the group consisting of: sodium, potassium, magnesium, calcium, aluminum, lithium, ammonium, monoethanol ammonium, diethanolammonium, and triethanolammonium; and wherein said salt and salt hydrate have an anion selected from the group consisting of: chloride, bromide, sulfate, metasilicate, orthophosphate, pyrophosphate, polyphosphate, metaborate, tetraborate, carbonate, bicarbonate, hydrogen phosphate, isethionate, methyl sulfate, and mono- and polycarboxylate of 6 carbon atoms or less;

from about 0.5% to about 30% of a starch;

from about 1% to about 20% of an amphoteric co-surfactant selected from the group consisting of alkyl betaines, alkyl sultaines, and trialkyl amine oxides; and mixtures thereof;

from about 0.1% to about.40% of a hydrophobic material selected from the group consisting of: microcrystalline wax, petrolatum, carnauba wax, palm wax, candelilla wax, sugarcane wax, vegetable derived triglycerides, beeswax, spermaceti, lanolin, wood wax, shellac wax, animal derived triglycerides, montar, paraffin, ozokerite, ceresin, and Fischer-Tropsch wax.

The preferred level of said amphoteric co-surfactant is from about 2% to about 10% and the amphoteric co-surfactant is selected from the group consisting of: cocobetaine, cocoamidopropylbetaine, cocodimethylamine oxide, and cocoamidopropyl hydroxysultaine.

The bar can preferably contain from about 2% to about 35% of said hydrophobic material; said hydrophobic material comprising paraffin wax, having a melting point of from about 49° C. (120° F.) to about 85° C. (185° F.), and petrolatum, and mixtures thereof; the bar can more preferably contain from about 3% to about 15% by weight of the bar of paraffin wax.

The bar can preferably contain from about 1% to about 20% of said salts and said salt is selected from the group consisting of: sodium chloride, sodium sulfate, disodium hydrogen phosphate, sodium pyrophosphate, sodium tetraborate, sodium acetate, sodium citrate, and sodium isethionate, and mixtures thereof.

The bar can more preferably contain salt at a level of from about 4% to about 15% and said salt is preferably selected from the group consisting of sodium chloride and sodium isethionate.

The bar can preferably contain: from about 1% to about 15% by weight of said impalpable water-insoluble materials; from about 0.1% to about 3%, of said polymeric skin feel aid, said polymeric skin feel aid selected from the group consisting of guar, quaternized guar, and quaternized polysaccharides; from about 1% to about 15% said aluminosilicate and/or other clays; and from about 1% to about 15% said starch; wherein said starch is selected from the group consisting of corn starch and dextrin.

The aqueous phase mix alone contains from about 20% to about 95% water by weight of said aqueous phase. The aqueous phase can contain from about 35% to about 75% water by weight of said aqueous phase.

The bar can have miscellaneous non-carboxylic acid phases comprising droplets or crystals selected from waxes, petrolatum, and clays.

The above cleansing bar is preferred when said bar contains said carboxylic acid and water; and some synthetic surfactant bar firmness and/or lather boosters selected from the group consisting of: alkyl sulfates, paraffin sulfonates, alkylglycerylether sulfonates, acyl sarcosinates, methylacyl taurates, linear alkyl benzene sulfonates, N-acyl glutamates, alkyl glucosides, alpha sulfo fatty acid esters, acyl isethionates, alkyl sulfosuccinates, alkyl ether carboxylates, alkyl phosphate esters, ethoxylated alkyl phosphate esters, methyl glucose esters, protein condensates, alkyl amine oxides, alkyl betaines, alkyl sultaines, the alkyl ether sulfates with 1 to 12 ethoxy groups, and mixtures thereof, wherein said surfactants contain $C_8$–$C_{22}$ alkyl chains.

The above cleansing bar is preferred when said synthetic surfactant is hygroscopic; said hygroscopic surfactant being defined as a surfactant which absorbs at least 20% of its dry weight in water at 26° C. and 80% Relative Humidity in three days and wherein said bar is relatively non-swelling.

The above cleansing bar is preferred when said hygroscopic surfactant is selected from the group consisting of alpha sulfo fatty acid esters; alkyl sulfates; alkyl ether carboxylates; alkyl betaines; alkyl sultaines; alkyl amine oxides; alkyl ether sulfates; and mixtures thereof.

A Preferred Frame Process for Making the Bar

A process of making the above preferred cleansing bar of the present invention comprises the steps of:

I. forming a homogeneous pourable molten aqueous mixture of said water, said carboxylic acid, and said bar firmness aid with stirring at a temperature of from about 50° C. (120° F.) to about 95° C. (205° F.);

II. neutralizing from about 20% to about 65% of said carboxylic acid in Step I with a hydroxide having a cation selected from the group consisting of sodium, magnesium, calcium, aluminum, and mixtures thereof; preferably said bar firmness aid is added after said neutralizing, particularly when said bar firmness aid is a synthetic surfactant; and III. pouring said homogeneous pourable molten mixture into a bar shaped mold; and IV. crystallizing said molded molten mixture by cooling to provide said cleansing bar.

The pourable molten mixture preferably has a viscosity between 10 cps and 4,000 cps when measured at a shear rate of from about 1 to about 5 $sec^{-1}$ at about 80° C.; preferably from about 100 cps to about 2,000 cps; more preferably from about 500 cps to about 1,000 cps.

Step I stirring temperature is preferably from about 75° C. to 95° C.

The process Step IV cooling can be under ambient conditions.

The process aqueous mixture of Step I preferably comprises: from about 20% to about 30% of said water, from about 20% to about 30% of said carboxylic acid, and from about 20% to about 30% of synthetic surfactant.

The above process is preferred when the aqueous molten liquid is neutralized with sodium hydroxide.

The above process is preferred when from about 2% to about 15% by weight of said bar is a "crystallization enhancing salt" selected from the group consisting of: sodium salt of sulfate, chloride, acetate, isethionate, and citrate, and mixtures thereof.

The above process is preferred when said aqueous molten liquid aqueous phase contains from about 2% to about 40% of a bar firmness aid selected from the group disclosed herein.

The bar firmness aid appears to increase the level of said carboxylic acid dissolved in said continuous molten aqueous phase in Step I.

The above process is preferred when said aqueous phase contains from about 20% to about 95%, preferably from about 35% to about 75%, water by weight of said aqueous phase.

The preferred bar has a penetration value at 25° C. of from about 3 mm to about 9 mm.

The above process is preferred when said bar has miscellaneous non-carboxylic acid phases comprising droplets or crystals selected from synthetic surfactants, waxes, petrolatum, clays, and the like.

A highly preferred cleansing bar comprises: various combinations of the core structure of carboxylic acid fibers and/or platelets, water, bar firmness aids, mild synthetic surfactants, bar appearance stabilizers, skin mildness aides and other cleansing bar adjuvants. Such preferred bar can be formulated to have essentially no bar smear.

Some compositions of this invention comprise the above-defined rigid mesh with water and without water. These compositions must be formed with water or another suitable solvent system. The compositions can be made with large amounts of water and the water level in the final composition can be reduced to as low as about 1% or 2%.

However, it is a special advantage of some structures described herein that they can be dehydrated without loss of the integrity of the mesh. Some preferred shaped solids can be dehydrated without appreciable change in their outer dimensions. Other bars shrink while maintaining their three-dimensional form. Some bars herein have the unique characteristic that they are not destroyed by dehydration.

The percentages, ratios, and parts herein are on a total composition weight basis, unless otherwise specified. All levels and ranges herein are approximations unless otherwise specified.

Some preferred compositions contain little or no short chain FA's of ten carbon atoms or less as shown in Table A by weight of the carboxylic acid.

TABLE A

| The Total Percent Unsaturated or Low ($C_{10}$ or less) Chain Length Carboxylic Acids | | |
|---|---|---|
| Broad | Preferred | More Preferred |
| 0–15% | 0–5% | 0–1% |

The highs and lows of some key preferred optional ingredients for complex cleansing bar compositions of this invention are set out herein. None of these ingredients is essential for the basic, preferred bar core structure. Zero is the lowest level for each optional ingredient. Some preferred bars can contain a total of from about 0.1% up to about 70% of such ingredients. The idea here is that the core bars can contain large amounts of other ingredients besides fatty acids, bar firmness aids, soap, and water.

Examples of suitable synthetic detergents for use herein, as bar firmness aids or as lather booster "co-surfactants," are those described in U.S. Pat. No. 3,351,558, Zimmerer, issued Nov. 7, 1967, at column 6, line 70 to column 7, line 74, said patent incorporated herein by reference.

Examples include the water-soluble salts of organic, sulfonic acids and of aliphatic sulfuric acid esters, that is, water-soluble salts of organic sulfuric reaction products having in the molecular structure an alkyl radical of from 10 to 22 carbon atoms and a radical selected from the group consisting of sulfonic acid and sulfuric acid ester radicals.

Synthetic sulfate detergents of special interest are the normally solid alkali metal salts of sulfuric acid esters of normal primary aliphatic alcohols having from 10 to 22 carbon atoms. Thus, the sodium and potassium salts of alkyl sulfuric acids obtained from the mixed higher alcohols derived by the reduction of tallow or by the reduction of coconut oil, palm oil, stearine, palm kernel oil, babassu kernel oil or other oils of the coconut group can be used herein.

Other aliphatic sulfuric acid esters which can be suitably employed include the water-soluble salts of sulfuric acid esters of polyhydric alcohols incompletely esterified with high molecular weight soap-forming carboxylic acids. Such synthetic detergents include the water-soluble alkali metal salts of sulfuric acid esters of higher molecular weight fatty acid monoglycerides such as the sodium and potassium salts of the coconut oil fatty acid monoester of 1,2-hydroxypropane-3-sulfuric acid ester, sodium and potassium monomyristoyl ethylene glycol sulfate, and sodium and potassium monolauroyl diglycerol sulfate.

The synthetic surfactants and other optional materials useful in conventional cleaning products are also useful in the present invention. In fact, some ingredients such as certain hygroscopic synthetic surfactants which are normally used in liquids and which are very difficult to incorporate into normal cleansing bars are very compatible in the bars of the present invention. Thus, essentially all of the known synthetic surfactants which are useful in cleansing products are useful in the compositions of the present invention. The cleansing product patent literature is full of synthetic surfactant disclosures. Some preferred surfactants as well as other cleansing product ingredients are disclosed in the following references:

| U.S. Pat. No. | Issue Date | Inventor(s) |
|---|---|---|
| 4,061,602 | 12/1977 | Oberstar et al. |
| 4,234,464 | 11/1980 | Morshauser |
| 4,472,297 | 9/1984 | Bolich et al. |
| 4,491,539 | 1/1985 | Hoskins et al. |
| 4,540,507 | 9/1985 | Grollier |
| 4,565,647 | 1/1986 | Llenado |
| 4,673,525 | 6/1987 | Small et al. |
| 4,704,224 | 11/1987 | Saud |
| 4,788,006 | 11/1988 | Bolich, Jr., et al. |
| 4,812,253 | 3/1989 | Small et al. |
| 4,820,447 | 4/1989 | Medcalf et al. |
| 4,906,459 | 3/1990 | Cobb et al. |
| 4,923,635 | 5/1990 | Simion et al. |
| 4,954,282 | 9/1990 | Rys et al. |

All of said patents are incorporated herein by reference. Some preferred synthetic surfactants are shown the Examples herein. Preferred synthetic surfactant systems are selectively designed for bar firmness, bar appearance stability, lather, cleansing and mildness.

It is noted that surfactant mildness can be measured by a skin barrier destruction test which is used to assess the irritancy potential of surfactants. In this test the milder the surfactant, the lesser the skin barrier is destroyed. Skin barrier destruction is measured by the relative amount of radio-labeled water ($^3H$-$H_2O$) which passes from the test solution through the skin epidermis into the physiological buffer contained in the diffusate chamber. This test is described by T. J. Franz in the *J. Invest. Dermatol.*, 1975, 64, pp. 190–195; and in U.S. Pat. No. 4,673,525, Small et al., issued Jun. 16, 1987, incorporated herein by reference, and which disclose a mild alkyl glyceryl ether sulfonate (AGS) surfactant based synbar comprising a "standard" alkyl glyceryl ether sulfonate mixture. Barrier destruction testing is used to select mild surfactants. Some preferred mild synthetic surfactants are disclosed in the above Small et al. patents and Rys et al. Some specific examples of preferred surfactants are used in the Examples herein.

Some examples of good lather enhancing detergent surfactants, mild ones, are e.g., sodium lauroyl sarcosinate, alkyl glyceryl ether sulfonate, sulfonated fatty esters, paraffin sulfonates, and sulfonated fatty acids.

Numerous examples of other surfactants are disclosed in the patents incorporated herein by reference. They include other alkyl sulfates, anionic acyl sarcosinates, sodium cocoyl isethionate, methyl acyl taurates, N-acyl glutamates, acyl isethionates, alkyl sulfosuccinates, alkyl phosphate esters, ethoxylated alkyl phosphate esters, trideceth sulfates, protein condensates, mixtures of ethoxylated alkyl sulfates and alkyl amine oxides, betaines, sultaines, and mixtures thereof. Included in the surfactants are the alkyl ether sulfates with 1 to 12 ethoxy groups, especially ammonium and sodium lauryl ether sulfates.

Alkyl chains for these other surfactants are $C_8$–$C_{22}$, preferably $C_{10}$–$C_{18}$. Alkyl glycosides and methyl glucose esters are preferred mild nonionics which may be mixed with other mild anionic or amphoteric surfactants in the compositions of this invention. Alkyl polyglycoside detergents are useful lather enhancers. The alkyl group can vary from about 8 to about 22 and the glycoside units per molecule can vary from about 1.1 to about 5 to provide an appropriate balance between the hydrophilic and hydrophobic portions of the molecule. Combinations Of $C_8$–$C_{18}$, preferably $C_{12}$–$C_{16}$, alkyl polyglycosides with average degrees of glycosidation ranging from about 1.1 to about 2.7, preferably from about 1.2 to about 2.5, are preferred.

Sulfonated esters of fatty esters are preferred wherein the chain length of the carboxylic acid is $C_8$–$C_{22}$, preferably $C_{12}$–$C_{18}$; the chain length of the ester alcohol is $C_1$–$C_6$. These include sodium alpha sulfomethyl laurate, sodium alpha sulfomethyl cocoate, and sodium alpha sulfomethyl tallowate.

Amine oxide detergents are good lather enhancers. Some preferred amine oxides are $C_8$–$C_{18}$, preferably $C_{10}$–$C_{16}$, alkyl dimethyl amine oxides and $C_8$–$C_{18}$, preferably $C_{12}$–$C_{16}$, fatty acyl amidopropyl dimethyl amine oxides and mixtures thereof.

Fatty acid alkanolamides are good lather enhancers. Some preferred alkanolamides are $C_8$–$C_{18}$, preferably $C_{12}$–$C_{16}$, monoethanolamides, diethanolamides, and monoisopropanolamides and mixtures thereof.

Other detergent surfactants are alkyl ethoxy carboxylates having the general formula:

$$RO(CH_2CH_2O)_kCH_2COO^-M^+$$

wherein R is a $C_{8-22}$ alkyl group, k is an integer ranging from 0 to 10, and M is a cation; and polyhydroxy fatty acid amides having the general formula:

$$R^2-\overset{\overset{\displaystyle O}{\|}}{C}-\overset{\overset{\displaystyle R^1}{|}}{N}-Z$$

wherein $R^1$ is H, a $C_{1-4}$ alkyl group, 2-hydroxy ethyl, 2-hydroxy propyl, or mixtures thereof, $R^2$ is a $C_{5-31}$ hydrocarbyl, and Z is a polyhydroxyhydrocarbyl having a linear hydrocarbyl chain with at least 3 hydroxyl groups directly connected to the chain, or an alkoxylated derivative thereof.

Betaines are good lather enhancers. Betaines such as $C_8$–$C_{18}$, preferably $C_{12}$–$C_{16}$, alkyl betaines, e.g., coco betaines or $C_8$–$C_{18}$, preferably $C_{12}$–$C_{16}$, acyl amido betaines, e.g., cocoamidopropyl betaine, and mixtures thereof, are preferred.

Some of the preferred surfactants are hygroscopic synthetic surfactants which absorb at least about 20% of their dry weight at 26° C. and 80% relative humidity in three days. Hygroscopic surfactants help to improve bar lather. Some preferred hygroscopic synthetic surfactants are listed below. Note that all are not hygroscopic.

Hygroscopicity of Some Surfactants

The hygroscopic surfactants are defined herein as having a minimum of 20% total moisture gain after 3 days at 26° C. and 80% Relative Humidity.

| Class: Anionics | Total % Moisture Pick-Up* |
|---|---|
| Sulfonates | |
| Sodium $C_8$ Glyeryl Ether Sulfonate | 39.8 |
| Sodium $C_{12-17}$ Glyceryl Ether Sulfonate | 22.9 |
| Sodium $C_{16}$ Glyceryl Ether Sulfonate | 71.4 |
| Sodium Cocomonoglyceride Sulfonate | 3.5 |
| Sodium Salt of $C_{8-16}$ Alkyl Glyceryl Ether Sulfonates | |
| Alpha Sulfo Esters and Acids | |
| Sodium Alpha Sulfo Methyl Laurate/Myristate | 39.3 |
| Sodium Alpha Sulfo Methyl Myristate | 44.5 |
| Sodium Alpha Sulfo Hexyl Laurate | 23.2 |
| Sodium Alpha Sulfo Methyl/Hexyl Laurate and Myristate | 26.3 |
| Sodium Alpha Sulfo Methyl Palmitate | 3.7 |
| Sodium Alpha Sulfo Methyl Stearate | 4.2 |
| Sodium 2-Sulfo Lauric Acid | 0.2 |
| Sodium 2-Sulfo Palmitic Acid | 3.8 |
| Sodium 2-Sulfo Stearic Acid | 0.0 |
| $Na^+R_1-C(SO_3^-)-CO_2R_2$ $R_1 = C_{8-14}$ alkyl; $R_2 = C_{1-8}$ alkyl | |
| Sodium Acyl Isethionates | |
| Sodium Lauroyl Isethionate | 31.7 |
| Sodium Cocoyl Isethionate | 11.0 |
| Sarcosinates | |
| Sodium Lauryl Sarcosinate | 8.8 |
| Sodium Stearyl Sarcosinate | 13.3 |
| Sodium Cocoyl Sarcosinate | 18.7 |
| Alkyl Sulfates | |
| Sodium Lauryl Sulfate | 28.2 |
| Sodium Laureth-1 Sulfate | 37.6 |
| Sodium Oleyl Sulfate | 20.3 |
| Sodium Cetearyl Sulfate | 4.7 |
| Sodium Cetyl Sulfate | 2.25 |
| $Na + R_1(OCH_2CH_2)_nOSO_3^-$ $R_1 = C_{8-14}$ alkyl, $C_{16-20}$ alkyl(ene) with at least one double bond, n = 0–18 | |
| Acyl Glutamates | |
| Sodium Cocoyl Glutamate | 26.7 |
| Sodium Lauryl Glutamate | 17.8 |
| Sodium Myristyl Glutamate | 18.1 |
| Sodium Stearyl Glutamate | 12.0 |
| Alkyl Ether Carboxylates | |
| Sodium Laureth-5 Carboxylate | 32.2 |
| Sodium Palmityl-20 Carboxylate | 50.2 |

-continued

| Class: Anionics | Total % Moisture Pick-Up* |
|---|---|
| $Na + R_1—(O—CH_2CH_2)_nCO_2^-$ $R_1 = C_{8-18}$ alkyl, n = 1-30 | |
| Sulfosuccinates | |
| Disodium Laureth Sulfosuccinate | 33.6 |
| Phosphates | |
| Sodium Monoalkyl (70% $C_{12}$/30% $C_{14}$) Phosphate | 21.1 |
| Betaines | |
| Coco Betaine | 70.0 |
| Cocoamidopropyl Betaine | 48.2 |
| Palmitylamidopropyl Betaine | 46.5 |
| Isostearamidopropyl Betaine | 44.3 |
| Sultaines | |
| Cocoamidopropylhydroxy Sultaine | 59.5 |
| Amine Oxides | |
| Palmityl Dimethyl Amine Oxide | 34.0 |
| Myristyl Dimethyl Amine Oxide | 46.0 |
| Cocoamidopropyl Amine Oxide | 43.3 |
| Protein Derived | |
| Na/TEA $C_{12}$ Hydrolyzed Keratin | 34.7 |

*3 days, 26° C./80% Relative Humidity

Polymeric skin mildness aids are disclosed in the Small et al. and Medcalf et al. patents. Both cationic polysaccharides and cationic synthetic polymers are disclosed. The cationic synthetic polymers useful in the present invention are cationic polyalkylene imines, ethoxypolyalkylene imines, and poly[N-[3-(dimethylammonio)propyl]-N'-[3-(ethyleneoxyethylene dimethylammonio)propyl]urea di-chloride] the latter of which is available from Miranol Chemical Company, Inc. under the trademark of Miranol A-15, CAS Reg. No. 68555-36-2.

Preferred cationic polymeric skin conditioning agents of the present invention are those cationic polysaccharides of the cationic guar gum class with molecular weights of 1,000 to 3,000,000. More preferred molecular weights are from 2,500 to 350,000. These polymers have a polysaccharide backbone comprised of galactomannan units and a degree of cationic substitution ranging from about 0.04 per anhydroglucose unit to about 0.80 per anhydroglucose unit with the substituent cationic group being the adduct of 2,3-epoxypropyltrimethyl ammonium chloride to the natural polysaccharide backbone. Examples are JAGUAR C-14-S, C-15 and C-17 sold by Celanese Corporation. In order to achieve the benefits described in this invention, the polymer must have characteristics, either structural or physical which allow it to be suitably and fully hydrated and subsequently well incorporated into the soap matrix.

A mild neutral pH cleansing bar of the present invention can contain from about 0.5% to about 20% of a mixture of a silicone gum and a silicone fluid wherein the gum:fluid ratio is from about 10:1 to about 1:10, preferably from about 4:1 to about 1:4, most preferably from about 3:2 to about 2:3.

Silicone gum and fluid blends have been disclosed for use in shampoos and/or conditioners in U.S. Pat. Nos.:

U.S. Pat. No. 4,906,459, Cobb et al., issued Mar. 6, 1990;

U.S. Pat. No. 4,788,006, Bolich, Jr. et al., issued Nov. 29, 1988;

U.S. Pat. No. 4,741,855, Grote et al., issued May 3, 1988;

U.S. Pat. No. 4,728,457, Fieler et al., issued Mar. 1, 1988;

U.S. Pat. No. 4,704,272, Oh et al., issued Nov. 3, 1987; and

U.S. Pat. No. 2,826,551, Geen, issued Mar. 11, 1958, all of said patents being incorporated herein by reference.

The silicone component can be present in the bar at a level which is effective to deliver a skin mildness benefit, for example, from about 0.5% to about 20%, preferably from about 1.5% to about 16%, and most preferably from about 3% to about 12% of the composition. Silicone fluid, as used herein, denotes a silicone with viscosities ranging from about 5 to about 600,000 centistokes, most preferably from about 350 to about 100,000 centistokes, at 25° C. Silicone gum, as used herein, denotes a silicone with a mass molecular weight of from about 200,000 to about 1,000,000 and with a viscosity of greater than about 600,000 centistokes. The molecular weight and viscosity of the particular selected siloxanes will determine whether it is a gum or a fluid. The silicone gum and fluid are mixed together and incorporated into the compositions of the present invention.

Other ingredients of the present invention are selected for the various applications. E.g., perfumes can be used in formulating the skin cleansing products, generally at a level of from about 0.1% to about 2% of the composition. Alcohols, hydrotropes, colorants, and fillers such as talc, clay, water-insoluble, impalpable calcium carbonate and dextrin can also be used. Cetearyl alcohol is a mixture of cetyl and stearyl alcohols. Preservatives, e.g., sodium ethylenediaminetetraacetate (EDTA), generally at a level of less than 1% of the composition, can be incorporated in the cleansing products to prevent color and odor degradation. Antibacterials can also be incorporated, usually at levels up to 1.5%. The above patents disclose or refer to such ingredients and formulations which can be used in the bars of this invention, and are incorporated herein by reference.

Bar Appearance Aids

Bar appearance (water-retaining and/or shrinkage prevention) aids are preferably selected from the group consisting of:

compatible salt and salt hydrates;
water-soluble organics such as polyols, urea;
aluminosilicates and clays; and
mixtures thereof.

Some of these water-soluble organics serve as co-solvents which are used as bar firmness aids. They also serve to stabilize the appearance of the bar of the present invention. Some preferred water-soluble organics are propylene glycol, glycerine, ethylene glycol, sucrose, and urea, and other compatible polyols.

A particularly suitable water-soluble organic is propylene glycol. Other compatible organics include polyols, such as ethylene glycol or 1,7-heptane-diol, respectively the mono- and polyethylene and propylene glycols of up to about 8,000 molecular weight, any mono-$Cl_{1-4}$ alkyl ethers thereof, sorbitol, glycerol, glycose, diglycerol, sucrose, lactose, dextrose, 2-pentanol, 1-butanol, mono- di- and triethanolammonium, 2-amino-1-butanol, and the like, especially the polyhydric alcohols.

The term "polyol" as used herein includes non-reducing sugar, e.g., sucrose. Sucrose will not reduce Fehling's solution and therefore is classified as a "non-reducing" disaccharide. Unless otherwise specified, the term "sucrose" as used herein includes sucrose, its derivatives, and similar non-reducing sugars and similar polyols which are substantially stable at a soap processing temperature of up to about 210° F. (98° C.), e.g., trehalose, raffinose, and stachyose; and sorbitol, lactitol and maltitol.

Compatible salt and salt hydrates are used to stabilize the bar soap appearance via the retention of water. Some preferred salts are sodium chloride, sodium sulfate, disodium hydrogen phosphate, sodium isethionate, sodium pyrophosphate, sodium tetraborate.

Generally, compatible salts and salt hydrates include the sodium, potassium, magnesium, calcium, aluminum, lithium, and ammonium salts of inorganic acids and small (6 carbons or less) carboxylic or other organic acids, corresponding hydrates, and mixtures thereof, are applicable. The inorganic anions include chloride, bromide, sulfate, metasilicate, orthophosphate, pyrophosphate, polyphosphate, metaborate, tetraborate, and carbonate. The organic salts include acetate, formate, isethionate, methyl sulfate, and citrate.

Water-soluble amine salts can also be used. Monoethanolamine, diethanolamine, and triethanolammonium (TEA) chloride salts are preferred.

Aluminosilicates and other clays are useful in the present invention. Some preferred clays are disclosed in U.S. Pat. Nos. 4,605,509 and 4,274,975, incorporated herein by reference.

Other types of clays include zeolite, kaolinite, montmorillonite, attapulgite, illite, bentonite, and halloysite. Another preferred clay is kaolin.

Waxes include petroleum based waxes (paraffin, microcrystalline, and petrolatum), vegetable based waxes (carnauba, palm wax, candelilla, sugarcane wax, and vegetable derived triglycerides) animal waxes (beeswax, spermaceti, wool wax, shellac wax, and animal derived triglycerides), mineral waxes (montar, ozokerite, and ceresin) and synthetic waxes (Fischer-Tropsch).

A preferred wax is used in the Examples herein. A useful wax has a melting point (M.P.) of from about 120° F. to about 185° F. (49°-85° C.), preferably from about 125° F. to about 175° F. (52°-79° C.). A preferred paraffin wax is a fully refined petroleum wax having a melting point ranging from about 130° F. to about 140° F. (49°-60° C.). This wax is odorless and tasteless and meets FDA requirements for use as coatings for food and food packages. Such paraffins are readily available commercially. A very suitable paraffin can be obtained, for example, from The Standard Oil Company of Ohio under the trade name Factowax R-133.

Other suitable waxes are sold by the National Wax Co. under the trade names of 9182 and 6971, respectively, having melting points of 131° F. and 130° F. (~55° C.). Another suitable wax is sold by Exxon Corp. under the trade name 158, having a melting point of 158° F. (70° C.).

The paraffin preferably is present in the bar in an amount ranging from about 5% to about 20% by weight. The paraffin ingredient is used in the product to impart skin mildness, plasticity, firmness, and processability. It also provides a glossy look and smooth feel to the bar.

The paraffin ingredient is optionally supplemented by a microcrystalline wax. A suitable microcrystalline wax has a melting point ranging, for example, from about 140° F. (60° C.) to about 185° F. (85° C.), preferably from about 145° F. (62° C.) to about 175° F. (79° C.). The wax preferably should meet the FDA requirements for food grade microcrystalline waxes. A very suitable microcrystalline wax is obtained from Witco Chemical Company under the trade name Multiwax X-145A. The microcrystalline wax preferably is present in the bar in an amount ranging from about 0.5% to about 5% by weight. The microcrystalline wax ingredient imparts pliability to the bar at room temperatures.

EXAMPLES

The following examples are illustrative and are not intended to limit the scope of the invention. All levels and ranges, temperatures, results, etc., used herein, are approximations unless otherwise specified.

Description of Testing for Examples

Bar Hardness Test

1. The hardness of a bar is determined by measuring at 25° C. the depth of penetration (in mm) into the bar, as described herein. A separate elevated temperature bar hardness can also be measured at 49° C.

Bar Smear Test

2. The smear grade is determined by a (1) placing a soap bar on a perch in a 1400 mm diameter circular dish; (2) adding 200 ml of room temperature water to the dish such that the bottom 3 mm of the bar is submerged in water; (3) letting the bar soak overnight (17 hours); (4) turning the bar over and grading qualitatively for the combined amount of smear, and characteristics of smear, depth of smear on a scale where 10 equals no smear, 8.0–9.5 equals low smear amount, 5.0–7.5 equals moderate smears similar to most marketed bars, and 4.5 or less equals very poor smear.

Commercial soap bars, e.g., SAFEGUARD®, ZEST®, IVORY®, and LAVA®, have smears of about 5, 6, 6, and 6, respectively.

A Frame Process for Making the Bars of the Present Invention

The cleansing bars in the Examples are made by the following general procedure unless otherwise specified:

1. Free fatty acid, propylene glycol, sodium hydroxide, sodium chloride, and water (excluding water coming in with other raw materials) are mixed and heated to 180° F. (82° C.).
2. Other ingredients are added preferably in the following order and the temperature is maintained at ~82° C.: coco betaine; sodium lauroyl sarcosinate; or sodium alpha sulfo methyl cocoate; kaolin clay; or hydrated zeolite (synthetic sodium aluminosilicate); and paraffin. Perfume is added last.

3. The molten liquid mixture is poured into shaped molds.
4. The molten liquid crystallizes (solidifies) on cooling to room temperature and the resultant bars are removed from the molds.

The bars of the examples are made using the above general procedure, unless otherwise specified.

TABLE I

Primarily Soap Bar Comparative Examples

| Ingredient | Comparative Examples: A Wt. % | B Wt. % | C Wt. % | D Wt. % |
|---|---|---|---|---|
| Sodium Myristate | 34.0 | 30.6 | 29.2 | 26.3 |
| Myristic Acid | 1.0 | 4.4 | 5.8 | 8.7 |
| Water | 65 | 65 | 65 | 65 |
| Sodium Myristate/Myristic Acid Ratio | 34:1 | 7:1 | 5:1 | 3:1 |
| Penetration, mm | 5.8 | 7.3 | 9.0 | 11.7 |
| pH | −9.5 | * | * | * |

*pH difficult to measure.

TABLE II

Soft Compositions without Firmness Aid

| Ingredient | Comparative Examples: E Wt. % | F Wt. % |
|---|---|---|
| Sodium Myristate | 23.4 | 17.5 |
| Myristic Acid | 11.6 | 17.5 |
| Water | 65 | 65 |
| Penetration, mm | 12.0 | 17.1 |
| Sodium Myristate/Myristic Acid Ratio | 2:1 | 1:1 |

In the above tables, firm bars are formed from predominate soap and water bars, with no additional bar firmness aid required. Comparative Examples A, B, C, and D have soap/carboxylic acid ratios of 34:1, 7:1, 5:1, and 3:1 respectively, and have penetration values of 5.8, 7.3, 9.0, and 11 mm, respectively. However, when the soap/carboxylic acid ratio exceeds 2:1, unacceptably soft bars are obtained. Comparative examples E and F have soap/carboxylic acid ratios of 2:1 and 1:1, respectively, and penetration values of 12.0 mm and 17.1 mm, respectively.

TABLE III

Neutral pH Frame Bars with Co-Solvent vs. Comp. Ex. G

| Ingredient | Examples: Comp. G Wt. % | H Wt. % | I Wt. % |
|---|---|---|---|
| Myristic Acid | 17.5 | 17.5 | 17.5 |
| Sodium Myristate | 17.5 | 17.5 | 17.5 |
| Propylene Glycol | 0.0 | 15.0 | 25.0 |
| Water | 65.0 | 50.0 | 40.0 |
| Penetration, mm | 17.6 | 10.2 | 7.3 |

The above examples H and I demonstrate that the addition of a co-solvent propylene glycol, results in a surprisingly improved structure, as demonstrated by increasingly harder bars with an increasing level of propylene glycol. The aqueous phases in H and I comprise propylene glycol and water which alone (without the carboxylic acid) are thin solutions.

TABLE IV

Preferred Neutral Frame Bars

| Ingredient | Examples: J Wt. % | K Wt. 5 |
|---|---|---|
| Sodium Myristate | 8.3 | 7.5 |
| Myristic Acid | 13.9 | 12.5 |
| Sodium Lauroyl Isethionate | — | 6.2 |
| Sodium Linear Alkyl Benzene Sulfonate | 0.6 | 0.5 |
| Sodium Cocoyl Isethionate | 27.5 | 18.5 |
| Altowhite Clay | 4.0 | 3.6 |
| Lactose | — | 10.0 |

TABLE IV-continued

Preferred Neutral Frame Bars

| Ingredient | Examples: J Wt. % | K Wt. 5 |
|---|---|---|
| Paraffin Wax | 9.1 | 8.1 |
| Sodium Isethionate | 3.4 | 3.1 |
| Sodium Chloride | 0.3 | 0.3 |
| Fragrance | — | 0.6 |
| Glydant | — | 0.2 |
| Miscellaneous Minors | 4.9 | 4.0 |
| Water | 28.0 | 24.9 |
| Penetration, mm | 6.1 | 6.6 |
| Smear | 9.5 | 8.0 |
| Lather, Soil | 2.5 | 4.0 |
| pH | −7 | −7 |

The above preferred neutral pH frame bars are film bars with excellent smear and good lathers. Examples J and K have about 22% and 20% total monocarboxylic acid, respectively, with 37% and 37% neutralized. Example J has 28% synthetic surfactant bar firmness aid. Example K has 34% total bar firmness aid, of which 24% is synthetic surfactant and 10% is a co-solvent.

TABLE V

Unbalanced Formulae - Soft Comparative Examples

| Ingredient | Comparative Examples: L Wt. % | M Wt. % | N Wt. % |
|---|---|---|---|
| Sodium Myristate | 17.5 | 17.5 | — |
| Myristic Acid | 17.5 | 17.5 | — |
| Sodium Cocoyl Isethionate | 15.0 | 25.0 | 41.6 |
| Miscellaneous Minors | 1.0 | 1.6 | — |
| Water | 49.0 | 38.4 | 58.4 |
| Penetration, mm | 14.3 | 13.0 | 21.7 |
| pH | 7.3 | 7.3 | — |

Comparative Examples L, M, and N in Table V do not form firm bars having penetration values of 14.3, 13.0, and 21.7. Care must be exercised to balance the levels of carboxylic acid, bar firmness aid, water, etc. Note that the ratio of SCI and water are about the same for Comparative Examples M and N. Comparative Example N is an "aqueous phase" without any carboxylic acid. See Examples O and P for balanced formulations.

TABLE VI

Neutral pH Bars with Sufficient Bar Firmness Aid

| Ingredient | Examples: O Wt. % | P Wt. % |
|---|---|---|
| Sodium Myristate | 9.7 | 9.0 |
| Myristic Acid | 16.2 | 15.0 |
| Sodium Cocoyl Isethionate | 35.0 | 40.0 |
| Sodium Linear Alkyl Benzene Sulfonate | 0.7 | 2.0 |
| Sodium Isethionate | 4.0 | 5.0 |
| Sodium Chloride | 0.3 | 0.3 |
| Titanium Dioxide | 0.3 | — |
| Miscellaneous Minors | 2.2 | 2.6 |
| Water | 31.6 | 26.1 |
| Penetration, mm | 7.6 | 7.1 |

In Table VI, increasing levels of sodium cocoyl isethionate and more free fatty acid vs. soap result in firmer bars with penetration values of 7.6 and 7.1, respectively.

TABLE VII

Neutral pH Bars with and without Co-Solvent Comparative Q and S vs. R and T, Respectively

| Ingredient | Examples: Comp. Q Wt. % | R Wt. % | Comp. S Wt. % | T Wt. % |
|---|---|---|---|---|
| Sodium Myristate | 17.5 | 17.5 | 17.5 | 17.5 |
| Myristic Acid | 17.5 | 17.5 | 17.5 | 17.5 |
| Sodium Cocoyl Isethionate | 15.0 | 15.0 | 25.0 | 25.0 |
| Propylene Glycol | — | 5.0 | — | 5.0 |
| Miscellaneous Minors | 1.0 | 1.0 | 1.6 | 1.6 |
| Water | 49.0 | 44.0 | 38.4 | 33.4 |
| pH | 7.3 | 7.3 | 7.3 | 7.4 |
| Penetration, mm | 14.3 | 10.2 | 13.0 | 9.1 |
| Smear | 7.5 | 9.0 | — | 7.5 |

In Table VII, the addition of 5% propylene glycol to Examples R and T increases the firmness of bars of Comparative Examples Q and S formulations.

TABLE VIII

Neutral pH Bars with Different Chain Length Carboxylic Acids

| Ingredient | Examples: U Wt. % | V Wt. % | W Wt. % |
|---|---|---|---|
| Sodium Laurate ($C_{12}$) | 8.4 | — | — |
| Sodium Palmitate ($C_{16}$) | — | — | 8.1 |
| Sodium Myristate ($C_{14}$) | — | 8.1 | — |
| Lauric Acid ($C_{12}$) | 14.0 | — | — |
| Myristic Acid ($C_{14}$) | — | 13.5 | — |
| Palmitic Acid ($C_{16}$) | — | — | 13.5 |
| Sodium Lauroyl Isethionate | 7.0 | 6.7 | 6.7 |
| Sodium Cocoyl Isethionate | 21.1 | 20.3 | 20.3 |
| Sodium Linear Alkyl Benzene Sulfonate | 0.7 | 0.7 | 0.7 |
| Corn Starch | 7.8 | 10.8 | 10.8 |
| Altowhite Clay | 3.8 | 3.9 | 3.9 |
| Sodium Isethionate | 6.1 | 3.6 | 3.6 |
| Sodium Chloride | 0.3 | 0.3 | 0.3 |
| Fragrance | 0.6 | — | 0.6 |
| Glydant | 0.2 | 0.2 | |
| Miscellaneous Minors | 2.7 | 4.0 | 4.0 |
| Water | 27.4 | 27.9 | 27.3 |
| pH | 6.7 | 7.3 | 7.5 |
| Penetration, mm | 11.7 | 5.7 | 4.8 |
| Smear | 5.0 | 9.5 | 9.5 |

Tables VIII and IX show that by increasing the chain length of the carboxylic acid increases the firmness of the bars. Lauric acid ($C_{12}$, Example U) has marginal penetration value (11.7 mm) and poor smear. Myristic acid ($C_{14}$, Example V), palmitic acid ($C_{16}$, Example W), stearic acid ($C_{18}$, Example X), and behenic acid ($C_{22}$, Example Y) have penetration values of 5.7, 4.8, 4.4, and 3.6, respectively. Note that these bars have excellent smears.

TABLE IX

Neutral pH Bars with Different Chain Length Carboxylic Acids

| Ingredient | Examples: X Wt. % | Y Wt. % |
|---|---|---|
| Sodium Stearate ($C_{18}$) | 8.1 | 0.0 |
| Sodium Behenate ($C_{22}$) | — | 8.1 |
| Stearic Acid ($C_{18}$) | 13.5 | — |
| Behenic Acid ($C_{22}$) | — | 13.5 |
| Sodium Lauroyl Isethionate | 6.7 | 6.7 |
| Sodium Cocoyl Isethionate | 20.3 | 20.3 |
| Sodium Linear Alkyl Benzene Sulfonate | 0.7 | 0.7 |
| Corn Starch | 10.8 | 10.8 |
| Altowhite Clay | 3.9 | 3.9 |
| Sodium Isethionate | 3.6 | 3.6 |

TABLE IX-continued

Neutral pH Bars with Different Chain Length Carboxylic Acids

| Ingredient | Examples: X Wt. % | Y Wt. % |
|---|---|---|
| Sodium Chloride | 0.3 | 0.3 |
| Fragrance | 0.6 | 0.6 |
| Glydant | 0.2 | 0.2 |
| Miscellaneous Minors | 4.0 | 4.0 |
| Water | 27.3 | 27.3 |
| pH | 6.7 | 7.2 |
| Penetration, mm | 4.4 | 3.6 |
| Smear | 9.5 | 9.5 |

TABLE X

Neutral pH Bars with Different Carboxylic Acids

| Ingredient | Examples: Z Wt. % | AA Wt. % | BB Wt. % |
|---|---|---|---|
| Sodium Myristate | 13.8 | — | 2.9 |
| Sodium Stearate | — | 13.8 | 6.8 |
| Myristic Acid | 23.1 | — | 4.9 |
| Stearic Acid | — | 23.1 | 11.3 |
| Sodium Cocoyl Isethionate | 22.0 | 22.0 | 35.0 |
| Sodium Linear Alkyl Benzene Sulfonate | 1.0 | 1.0 | 0.7 |
| Paraffin Wax | | | |
| Sodium Isethionate | 5.7 | 5.7 | 4.0 |
| Sodium Chloride | 0.5 | 0.5 | 0.3 |
| Miscellaneous Minors | 1.4 | 1.4 | 2.2 |
| Water | 32.0 | 32.0 | 31.9 |
| pH | 7.1 | 7.1 | 7.7 |
| Penetration, mm | 8.8 | 7.3 | 7.2 |
| Smear | 9.5 | 10.0 | 8.5 |

Table X shows that firm bars are formed when the base carboxylic acid is either myristic acid (Ex. Z), stearic acid (Ex. AA), or a mixture of the two carboxylic acids (Ex. BB).

TABLE XI

Neutral pH Bars with Mixed Carboxylic Acids

| Ingredient | Examples: CC Wt. % | DD Wt. % |
|---|---|---|
| Sodium Myristate | 1.6 | 8.7 |
| Sodium 12-Hydroxy Stearate | 3.4 | 1.0 |
| Myristic Acid | 3.4 | 14.6 |
| 12-Hydroxy Stearic Acid | 7.6 | 1.6 |
| Sodium Lauroyl Isethionate (SLI) | 18.3 | — |
| Sodium Cocoyl Isethionate (SCI) | 9.4 | 35.0 |
| Sodium Linear Alkyl Benzene Sulfonate (LAS) | 2.5 | 0.7 |
| Sodium Lauroyl Sarcosinate (SLS) | 4.0 | — |
| Coco Betaine | 8.0 | — |
| Altowhite Clay | 5.5 | — |
| Sodium Isethionate | — | 4.0 |
| Paraffin Wax | 10.0 | — |
| Sodium Chloride | 1.7 | 0.4 |
| Titanium Dioxide | 0.3 | — |
| Miscellaneous Minors | 4.1 | 2.2 |
| Water | 20.5 | 31.9 |
| pH | 6.8 | 7.6 |
| Penetration, mm | 5.9 | 5.4 |
| Smear | 8.5 | 9.5 |

Table XI shows that carboxylic acid mixtures of myristic acid and 12-Hydroxy Stearic Acid form firm bars; SLI, SCI, SLS, and LAS are the bar firmness aids in Example CC, and SCI and LAS are the bar firmness aids in DD. Note that Example CC contains 8% coco betaine amphoteric co-surfactant lather booster.

TABLE XII

Neutral pH Bars with Different Non-Sodium Cations

| Ingredient | Examples: EE Wt. % | FF Wt. % | GG Wt. % |
|---|---|---|---|
| Sodium Myristate | 17.5 | — | — |
| Calcium Myristate | — | 17.5 | — |
| Aluminum Myristate | — | — | 17.5 |
| Myristic Acid | 17.5 | 17.5 | 17.5 |
| Sodium Cocoyl Isethionate | 25.0 | 25.0 | 25.0 |
| Propylene Glycol | 5.0 | 5.0 | 5.0 |
| Water | 35.0 | 35.0 | 35.0 |
| Penetration, mm | 5.5 | 8.3 | 5.6 |
| Smear | 10.0 | 8.0 | 10.0 |

Tables XII and XIII show that carboxylic acid can be neutralized with different cations. Magnesium, calcium, and aluminum myristate (Examples EE, FF, and GG, respectively) form firm bars, but potassium and lithium myristate (Comparative Examples HH and II) do not. Magnesium hydroxide, calcium hydroxide, aluminum hydroxide, potassium hydroxide, and lithium hydroxide are used to form the neutralized carboxylic acids in Examples EE, FF, and GG, and Comparative Examples HH and II, respectively.

TABLE XIII

Neutral pH Comparative Li and K Cations

| Ingredient | Examples: HH Wt. % | II Wt. % |
|---|---|---|
| Potassium Myristate | 8.3 | — |
| Lithium Myristate | — | 17.5 |
| Myristic Acid | 13.9 | 17.5 |
| Sodium Cocoyl Isethionate (SLI) | 30.0 | 25.0 |
| Propylene Glycol | — | 5.0 |
| Altowhite Clay | 4.0 | — |
| Paraffin Wax | 9.0 | — |
| Sodium Isethionate | 3.4 | — |
| Potassium Chloride | 0.3 | — |
| Propylene Glycol | — | 5.0 |
| Miscellaneous Minors | 1.9 | — |
| Water | 28.7 | 35.0 |
| pH | 7.3 | 7.5 |
| Penetration, mm | 20.9 | 15.5 |

TABLE XIV

Neutral pH Bars with Various Synthetic Surfactant Bar Firmness Aids

| Ingredient | Examples: JJ Wt. % | KK Wt. % | LL Wt. % | MM Wt. % |
|---|---|---|---|---|
| Sodium Myristate | 8.0 | 8.0 | 8.0 | 8.0 |
| Myristic Acid | 25.0 | 25.0 | 25.0 | 25.0 |
| Sodium Laureth-3 Sulfate ($A_3S$) | 10.0 | — | 5.0 | — |
| Sodium Lauryl Methyl Ester Sulfonate (LMES) | — | 10.0 | 5.0 | 5.0 |
| Sodium Lauroyl Sarcosinate (SLS) | — | — | — | 5.0 |
| Propylene Glycol | 10.0 | 10.0 | 10.0 | 10.0 |
| Altowhite Clay | 4.0 | 4.0 | 4.0 | 4.0 |
| Paraffin Wax | 6.5 | 6.5 | 6.5 | 6.5 |
| Sodium Chloride | 2.0 | 2.0 | 2.0 | 2.0 |
| Miscellaneous Minors | 1.1 | 4.1 | 2.6 | 2.2 |
| Water | 33.4 | 30.4 | 31.9 | 32.3 |
| pH | 6.6 | — | — | — |
| Penetration, mm | 9.6 | 7.6 | 8.4 | 8.5 |
| Smear | 10.0 | 10.0 | 10.0 | 9.5 |

TABLE XV

Neutral pH Bars with Mixtures of Various Synthetic Surfactant Bar Firmness Aids

| Ingredient | Examples: NN Wt. % | OO Wt. % |
|---|---|---|
| Sodium Myristate | 8.0 | 8.0 |
| Myristic Acid | 25.0 | 25.0 |
| Sodium Lauryl Methyl Ester Sulfonate (LMES) | — | 10.0 |
| Sodium Cocoyl Isethionate (SCI) | 10.0 | 10.0 |
| Propylene Glycol | 10.0 | 4.0 |
| Altowhite Clay | 4.0 | 3.0 |
| Paraffin Wax | 6.5 | 5.0 |
| Sodium Chloride | 2.0 | 2.0 |
| Miscellaneous Minors | 0.7 | 4.7 |
| Water | 33.9 | 28.3 |
| pH | — | 6.4 |
| Penetration, mm | 6.0 | 10.6 |
| Smear | 10.0 | 8.5 |

In the above Tables XIV and XV, various synthetic surfactants are used as bar firmness aids and all the resultant bars are firm. Examples JJ, KK, and LL contain $AE_3S$, LMES, and the mixture of the two surfactants, respectively. Example MM contains a mixture of LMES and SLS, while examples NN and OO contain SCI and a mixture of SCI and LMES, respectively. $AE_3S$, LMES, and SLS are all very soluble surfactants that form thin solutions at 0.4:1 surfactant/water ratios or lower, yet these surfactants act as bar firmness aids in Examples JJ, KK, LL, and MM even though the surfactant/water ratio is 0.3:1, and the surfactants in the examples are likely totally dissolved.

The neutral pH bars of this invention are made by a frame process. A neutral pH freezer bar and process which requires special conditions are disclosed in commonly assigned, copending U.S. pat. appln. Ser. No. 07/854,931, Kacher et al., filed of even date, Mar. 20, 1992, now U.S. Pat. No. 5,225,098 incorporated herein by reference in its entirety. The following compositions Examples PP, QQ and RR in Table XVI can be used in a frame process, but are preferred neutral pH freezer bar compositions.

TABLE XVI

Preferred Neutral Freezer Bars

| Ingredient | Examples: PP Wt. % | QQ Wt. % | RR Wt. % |
|---|---|---|---|
| Sodium Myristate | 8.1 | 8.0 | 8.0 |
| Myristic Acid | 13.5 | 13.6 | 13.6 |
| Sodium Lauroyl Isethionate | 6.7 | 6.7 | 6.5 |
| Sodium Cocoyl Isethionate | 20.3 | 28.1 | 28.0 |
| Sodium Linear Alkyl Benzene Sulfonate | 0.7 | 0.7 | 0.7 |
| Corn Starch | 10.8 | — | — |
| Dextrin | — | 7.4 | 7.3 |
| Altowhite Clay | 3.9 | — | — |
| Paraffin Wax | — | 0.9 | 0.9 |
| Jaguar C145 | — | — | 1.0 |
| Sodium Isethionate | 3.6 | 4.1 | 4.0 |
| Sodium Chloride | 0.3 | 5.3 | 5.3 |
| Fragrance | 0.6 | 0.2 | 0.3 |
| Ethylene Diamine Tetraacetic Acid, tetra sodium salt | — | — | 0.2 |
| Glydant | 0.2 | 0.2 | 0.2 |
| Titanium Dioxide | — | — | 0.1 |
| Miscellaneous Minors | 4.4 | 5.4 | 5.3 |
| Water | 26.9 | 19.5 | 18.5 |

The Table XVI examples are preferred neutral pH cleansing bars made via Kacher et al.'s, supra, freezer bar process. The bars are firm bars and combine excellent smear characteristics and very good lather.

What is claimed is:

1. An neutral pH cleansing bar comprising: at least two phases and a sum total of from about 5% to about 50% of a mixture of free and neutralized monocarboxylic acid; from about 15% to about 65% of an anionic and/or nonionic bar firmness aid; and from about 15% to about 55% water by weight of said bar;

wherein said bar firmness aid is selected from the group consisting of:

I. from about 5% to about 50% by weight of a synthetic surfactant wherein said synthetic surfactant is selected from the group consisting of: alkyl sulfates, paraffin sulfonates, alkyl glyceryl ether sulfonates, anionic acyl sarcosinates, methyl acyl taurates, linear alkyl benzene sulfonates, N-acyl glutamates, alkyl glucosides, alpha sulfo fatty acid esters, acyl isethionates, glucose amide, alkyl sulfosuccinates, alkyl ether carboxylates, alkyl phosphate esters, ethoxylated alkyl phosphate esters, methyl glucose esters, protein condensates, the alkyl ether sulfates with 1 to 12 ethoxy groups, and mixtures thereof, wherein said surfactants contain $C_8$–$C_{22}$ alkylene chains; and mixtures thereof;

wherein said neutralized monocarboxylic acid and said synthetic surfactant sum is from about 10% to about 65% by weight of said bar; and II. from zero to about 40% by weight of a co-solvent wherein said co-solvent is selected from the group consisting of:

(a) non-volatile, water-soluble nonionic organic solvents selected from the group consisting of: a polyol of the structure:

$$R_3-O(CH_2-\underset{\underset{R_4}{|}}{CH}O)_kH$$

where $R_3$=H, $C_1$–$C_4$ alkyl; $R_4$=H, $CH_3$; and k=1–200; $C_2$–$C_{10}$ alkane diols; sorbitol; glycerine; sugars; sugar derivatives; urea; and ethanol amines of the general structure $(HOCH_2CH_2)_xNH_y$ where x=1–3; y=0–2; and x+y=3;

(b) alcohols of from 1 to 5 carbon atoms; and mixtures thereof; and

III. mixtures of (a) and (b);

wherein said free monocarboxylic acid is from about 35% to about 80% by weight of said mixture of free and neutralized monocarboxylic acid; and conversely, said neutralized carboxylic acid is from 20% to about 65% by weight of said mixture;

wherein one of said phases comprises a rigid crystalline phase skeleton structure comprising an interlocking, open three-dimensional mesh of elongated crystals comprising: said mixture of said free and neutralized carboxylic acid;

wherein said neutral pH is from about 6.3 to about 8.0;

wherein another of said phases is an aqueous phase mix; said mix (when measured alone) having a penetration value of greater than 12 mm to complete penetration at 25° C.; and wherein said cleansing bar has a penetration value of from zero up to 12 mm as measured at 25° C. using a 247 gram Standard Weighted Penetrometer Probe having a conical needle attached to a 9 inch (22.9 cm) shaft, weighing 47 grams with 200 grams on top of said shaft for a total of said 247 grams, said conical needle having a 19/32 inch (1.51 cm) top and a 1/32 inch (0.08 cm) point.

2. The neutral pH cleansing bar of claim 1 wherein at least 80% of said monocarboxylic acid has the following general formula:

$$H-(CH_2)_a-\underset{\underset{X}{|}}{CH}-(CH_2)_b-CO_2-H$$

wherein:

a+b=10 to 20 each a, b=0 to 20

X=H, OR, $$O-\overset{\overset{O}{\|}}{C}-R_1,\ R,$$

or mixtures thereof

R=$C_1$–$C_3$ alkyl, H, or mixtures thereof $R_1$=$C_1$–$C_3$ alkyl.

3. The firm, neutral pH cleansing bar of claim 1 wherein said bar has a penetration value of less than 12 mm at 49° C.

4. The neutral pH cleansing bar of claim 1 wherein said neutralized carboxylic acid is a sodium salt;

wherein said carboxylic acid is from about 15% to about 35% by weight of the bar;

wherein said synthetic surfactant is from about 10% to about 40% by weight of said bar; and said synthetic surfactant contains $C_{10}$–$C_{18}$ alkylene chains;

wherein said co-solvent is from 0% to about 30% by weight of said bar; and wherein said water is from about 20% to about 30% by weight of said bar.

5. The neutral pH cleansing bar of claim 2 wherein said monocarboxylic acid is selected from: X=H, and a+b=12–20; or X=OH, a=10–16, b=0; or 12-hydroxy stearic acid or mixtures thereof; and wherein said neutralized monocarboxylic acid is from about 20% to about 50% by weight of said monocarboxylic acid.

6. The neutral pH cleansing bar of claim 1 wherein said bar has a penetration value of from about 3 mm to about 9 mm.

7. The neutral pH cleansing bar of claim 2 wherein said bar comprises a rigid crystalline phase skeleton structure comprising an interlocking, open, three-dimensional mesh of elongated crystals consisting essentially of said monocarboxylic acid.

8. The neutral pH cleansing bar of claim 5 wherein said neutralized monocarboxylic acid is from 30% to about 40% by weight of said monocarboxylic acid;

wherein said neutralized carboxylic acid is a sodium salt;

wherein said monocarboxylic acid is from about 20% to about 30% by weight of said bar;

wherein said monocarboxylic acid X=H and a+b=-12–20 or said monocarboxylic acid is 12-hydroxy stearic acid; and wherein said water is from about 20% to about 30% by weight of said bar.

9. The neutral pH cleansing bar of claim 8 wherein said monocarboxylic acid is selected from the group consisting of myristic acid, behenic acid, and 12-hydroxy stearic acid and mixtures thereof.

10. The neutral pH cleansing bar of claim 4 wherein said synthetic surfactant level is from about 20% to about 30% by weight of said bar;

wherein said neutralized monocarboxylic acid and said synthetic surfactant sum is from about 25% to about 50% by weight of said bar; and wherein said synthetic surfactant is a sodium salt and is selected from the group consisting of: alkyl sulfates, alkyl glyceryl ether sulfonates, linear alkyl benzene sulfonates, alpha sulfo fatty acid esters, acyl isethionates, glucose amides, ethoxylated alkyl ether sulfates with 1 to 6 ethoxy groups, and mixtures thereof, wherein said surfactants contain $C_{10}$–$C_{18}$ alkylene chains, and mixtures thereof.

11. The neutral pH cleansing bar of claim 10 wherein said synthetic surfactant is a sodium acyl isethionate.

12. The neutral pH cleansing bar of claim 11 wherein said sodium acyl isethionate is selected from the group consisting of sodium cocoyl isethionate and sodium lauroyl isethionate, and mixtures thereof.

13. The neutral pH cleansing bar of claim 4 wherein said co-solvent level is from about 2% to about 15% by weight of said bar, and wherein said co-solvent is selected from the group consisting of: said polyol wherein $R_3$=H, and k=1–5; glycerine; sugars; sugar derivatives; urea; said ethanol amines, and mixtures thereof.

14. The neutral pH cleansing bar of claim 13 wherein said co-solvent is from about 2% to about 10% by weight of said bar, and wherein said co-solvent is selected from the group consisting of: propylene glycol, sucrose, lactose, glycerine, and mixtures thereof.

15. The neutral pH cleansing bar of claim 1 wherein said bar contains from about 0.1% to about 60% of other cleansing bar soap ingredients selected from the group consisting of:

from about 0.5% to about 3% said potassium soap;

from about 0.5% to about 3% triethanolammonium soap;

from about 1% to about 40% of impalpable water-insoluble materials selected from the group consisting of calcium carbonate and talc;

from about 0.1% to about 20% of a polymeric skin feel aid;

from about 0.5% to about 25% of aluminosilicate clay and/or other clays; wherein said aluminosilicates and clays are selected from the group consisting of zeolites; kaolin, kaolinite, montmorillonite, attapulgite, illite, bentonite, halloysite, and calcined clays;

from about 1% to about 40% of salt and salt hydrates; and mixtures thereof; wherein said salt and salt hydrate have a cation selected from the group consisting of: sodium, potassium, magnesium, calcium, aluminum, lithium, ammonium, monoethanol ammonium, diethanolammonium, and triethanolammonium; and wherein said salt and salt hydrate have an anion selected from the group consisting of: chloride, bromide, sulfate, metasilicate, orthophosphate, pyrophosphate, polyphosphate, metaborate, tetraborate, carbonate, bicarbonate, hydrogen phosphate, isethionate, methyl sulfate, and mono- and polycarboxylate of 6 carbon atoms or less;

from about 0.5% to about 30% of a starch;

from about 1% to about 20% of an amphoteric co-surfactant selected from the group consisting of alkyl betaines, alkyl sultaines, and trialkyl amine oxides; ana mixtures thereof;

from about 0.1% to about 40% of a hydrophobic material selected from the group consisting of: microcrystalline wax, petrolatum, carnauba wax, palm wax, candelilla wax, sugarcane wax, vegetable derived triglycerides, beeswax, spermaceti, lanolin, wood wax, shellac wax, animal derived triglycerides, montar, paraffin, ozokerite, ceresin, and Fischer-Tropsch wax.

16. The neutral pH cleansing bar of claim 15 wherein the level of said amphoteric surfactant is from about 3% to about 10% and the amphoteric surfactant is selected from the group consisting of: cocobetaine, cocoamidopropylbetaine, cocodimethylamine oxide, and cocoamidopropyl hydroxysultaine.

17. The neutral pH cleansing bar of claim 15 wherein said bar contains from about 2% to about 35% of said hydrophobic material; said hydrophobic material having a melting point of from about 49° C. (120° F.) to about 85° C. (185° F.) and is selected from the group consisting of said petrolatum and wax, and mixtures thereof.

18. The neutral pH cleansing bar of claim 17 wherein said bar comprises from about 3% to about 15% by weight of the bar of paraffin wax.

19. The neutral pH cleansing bar of claim 15 wherein said bar contains from about 1% to about 20% of said salts and said salt is selected from the group consisting of: sodium chloride, sodium sulfate, disodium hydrogen phosphate, sodium pyrophosphate, sodium tetraborate, sodium acetate, sodium citrate, and sodium isethionate, and mixtures thereof.

20. The neutral pH cleansing bar of claim 19 wherein said bar contains said salt at a level of from to about 15% and said salt is selected from the group consisting of sodium chloride and sodium isethionate.

21. The neutral pH cleansing bar of claim 15 wherein said bar contains: from about 1% to about 15% by weight of said impalpable water-insoluble materials; from about 0.1% to about 3%, of said polymeric skin feel aid, said polymeric skin feel aid selected from the group consisting of guar, quaternized guar, and quaternized polysaccharides; from about 1% to about 15% said aluminosilicate and/or other clays; and from about 1% to about 15% said starch; wherein said starch is selected from the group consisting of corn starch and dextrin.

22. The neutral pH cleansing bar of claim 1 wherein said aqueous phase mix alone contains from about 20% to about 95% water by weight of said aqueous phase.

23. The neutral pH cleansing bar of claim 1 wherein said aqueous phase contains from about 35% to about 75% water by weight of said aqueous phase.

24. The neutral pH cleansing bar of claim 1 wherein said bar has miscellaneous non-carboxylic acid phases comprising droplets or crystals selected from waxes, petrolatum, and clays.

25. The neutral pH cleansing bar of claim 1 wherein said bar has miscellaneous non-carboxylic acid phases comprising droplets or crystals of synthetic surfactant.

* * * * *